US010451008B2

(12) United States Patent
Benge

(10) Patent No.: US 10,451,008 B2
(45) Date of Patent: Oct. 22, 2019

(54) COMPRESSION SYSTEM

(71) Applicant: Precision Compression, LLC, Fort Worth, TX (US)

(72) Inventor: Brian Benge, Fort Worth, TX (US)

(73) Assignee: Precision Compression, LLC, Fort Worth, TX (US)

( * ) Notice: Subject to any disclaimer, the term of this patent is extended or adjusted under 35 U.S.C. 154(b) by 82 days.

(21) Appl. No.: 15/602,896

(22) Filed: May 23, 2017

(65) Prior Publication Data

US 2018/0030931 A1 Feb. 1, 2018

Related U.S. Application Data

(60) Provisional application No. 62/368,202, filed on Jul. 29, 2016.

(51) Int. Cl.

| | |
|---|---|
| ***F02M 21/02*** | (2006.01) |
| ***F02F 7/00*** | (2006.01) |
| ***F04D 17/12*** | (2006.01) |

(52) U.S. Cl.

CPC ..... *F02M 21/0215* (2013.01); *F02F 7/0082* (2013.01); *F02M 21/023* (2013.01); *F02M 21/0227* (2013.01); *F02M 21/0245* (2013.01); *F04D 17/12* (2013.01)

(58) Field of Classification Search

CPC ..... F02M 21/0215; F02M 21/0227; F02M 21/0245; F02M 21/023; F04D 17/12; F02F 7/0082

See application file for complete search history.

(56) References Cited

U.S. PATENT DOCUMENTS

| | | | | |
|---|---|---|---|---|
| 9,776,155 | B1 * | 10/2017 | Mueller | B01J 8/0285 |
| 2012/0079851 | A1 * | 4/2012 | Heath | B01D 3/06 62/617 |
| 2014/0166132 | A1 * | 6/2014 | Roberts | F04B 49/02 137/557 |

* cited by examiner

*Primary Examiner* — Xiao En Mo

(74) *Attorney, Agent, or Firm* — Decker Jones, P.C.; Brian K. Yost; Geoffrey A. Mantooth

(57) ABSTRACT

The compression system comprises a main fluid inlet adapted to receive a production stream of natural gas; first and second stage scrubbers; first and second compression units; first and second heat exchange units; one or more liquid dump containers; and an engine. The engine operates within a range of 1600-2100 revolutions per minute and the compressed gas comprises a pressure within a range of 360-600 pounds per square inch. The system comprises a weight to thousand cubic feet of gas per day ratio of less than twenty.

13 Claims, 1 Drawing Sheet

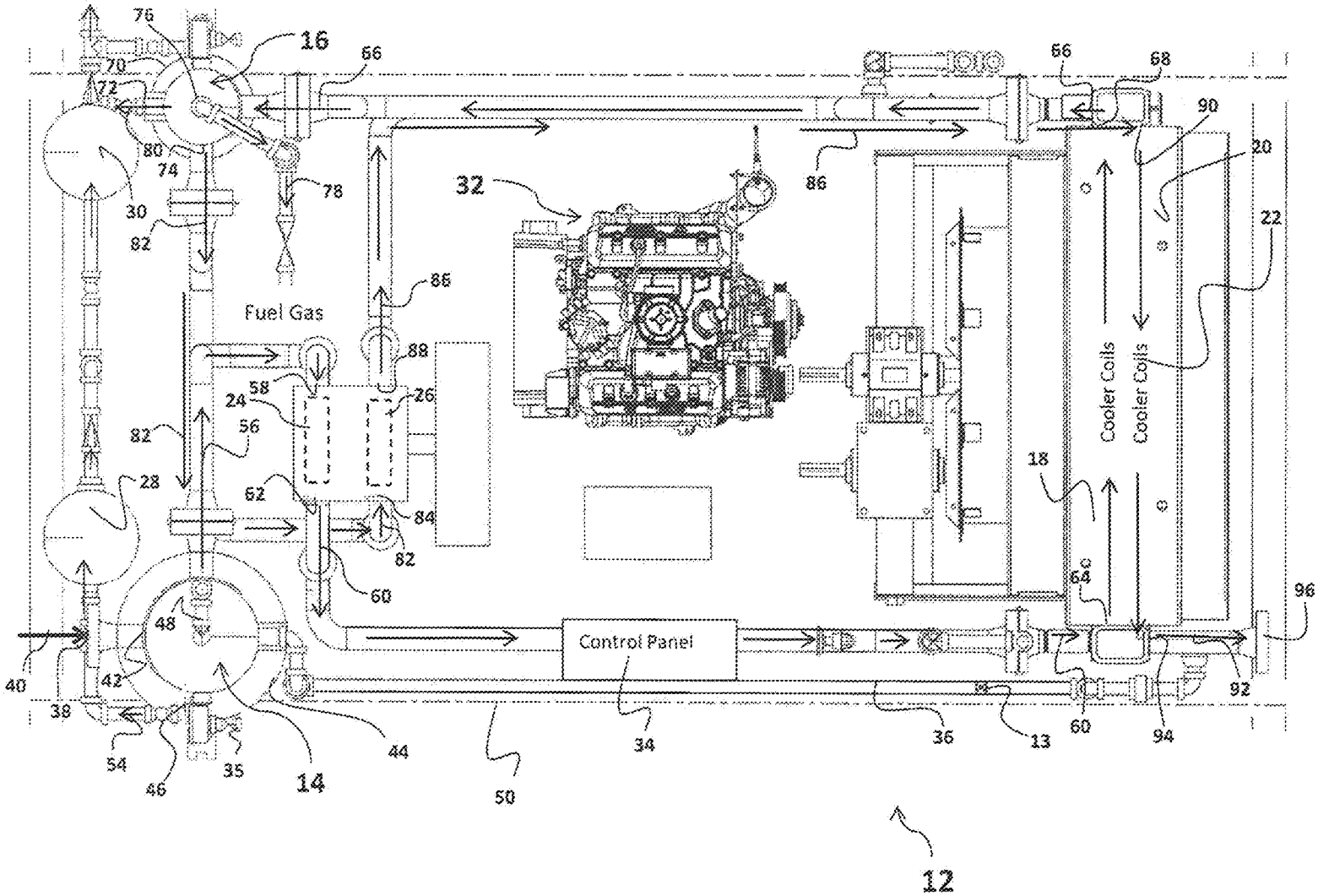
Cooler Coils
Cooler Coils
Control Panel
Fuel Gas
12
14
16
18
20
22
24
26
28
30
32
34
35
36
38
39
40
42
44
46
48
50
54
56
58
60
62
64
66
68
70
72
74
76
78
80
82
84
86
88
90
92
94
96
13

COMPRESSION SYSTEM

This application claims priority from provisional application 62/368,202 filed Jul. 29, 2016, the contents of which are incorporated by reference herein their entirety.

BACKGROUND OF THE INVENTION

1. Field of the Invention

The present invention relates generally to a compression system and specifically to an improved compression system that may be used for natural gas production.

2. Description of the Prior Art

Gas that comes directly from the ground ("raw natural gas") comprises various substances. Some substances are liquid and others are non-liquids. Prior to being transmitted through a gas pipeline, it is desirable to remove liquids from the gas so that the gas can be compressed and transported through the pipeline. Liquids can include water, natural gas condensate, and oil. Raw natural gas may also typically include contaminants such as carbon dioxide ($CO_2$) and hydrogen sulfide ($H_2S$).

Raw natural gas is collected from a well or group of wells. This raw gas is initially processed near the collection point. There, water, oil, natural gas condensate, and other liquids are removed from the raw product and the gas is prepared for transport to a gas processing plant for further processing.

During this initial stage, natural gas compressors are used. A compressor increases the pressure of the gas by reducing its volume so that the gas can be more readily transported through a pipe. In addition to initial compression activities performed at or near the wellsite, gas compressors are also used throughout the transportation pipeline to maintain sufficient pressure to deliver the gas to a desired location.

Prior art gathering compression systems are freestanding systems comprising scrubbers adapted to remove liquids, and compressors adapted to compress natural gas. Conventional scrubbers receive an inlet stream of raw natural gas. Because liquid descends and gas rises, within the scrubber, liquid particles fall from the inlet stream and exit the bottom of the scrubber. The scrubbed gas (gas resulting from a scrubbing treatment) exits through a scrubbed gas outlet.

The scrubbed natural gas is then compressed. As compressing natural gas causes the temperature of the gas to rise, it is desirable to cool the gas before releasing the gas to the transportation pipeline. Therefore, gas exiting the compressor travels through one or more heat exchange units comprising cooler coils.

The engine, scrubber, compressor, and heat exchange units are often mounted on a skid to permit the system to be readily constructed, delivered to the compression site, and removed when desired.

Prior art natural gas compression systems are often inefficient and expensive. What is needed is a natural gas compression system that efficiently and effectively scrubs, compresses, and cools natural gas.

SUMMARY OF THE INVENTION

A compression system is provided, generally comprising first and second stage scrubbers, first and second heat exchange units comprising cooler coils, first and second stage compression units, one or more liquid dump containers, an engine, a control unit, and a bypass line.

A gas inlet is adapted to receive a production stream of natural gas. The gas inlet is fluidly connected to a first stage scrubber inlet of the first stage scrubber. The first stage scrubber comprises a vessel, a first stage scrubber diverter, a liquid discharge outlet, and a gas discharge outlet. The liquid discharge outlet is positioned adjacent to a lower portion of the first stage scrubber. The gas discharge outlet is positioned at an upper portion of the first stage scrubber. First stage scrubber liquids flow out the discharge outlet into a first liquid dump container adapted to receive the first stage scrubber liquids removed from the production stream of natural gas. First stage scrubber gas exits the first stage scrubber through the first stage scrubber gas discharge outlet.

The first stage scrubber gas discharge outlet is fluidly connected to the first stage compression unit. The first stage scrubber gas enters the first stage compression unit through a first stage inlet. Within the first stage compression unit, the first stage scrubber gas is compressed to form first stage compressed gas. The first stage compressed gas exits the first stage compression unit through the first stage compression unit outlet. The first stage compression unit outlet is fluidly connected to a first heat exchange unit. The first stage compressed gas enters the first heat exchange unit through a first heat exchange unit inlet. The first stage compressed gas is cooled within the first heat exchange unit such that cooled first stage compressed gas is formed. The cooled first stage compressed gas exits a first heat exchange unit outlet. The first heat exchange unit outlet is fluidly connected to the second stage scrubber unit.

The cooled first stage compressed gas then enters the second stage scrubber. The second stage scrubber comprises a vessel, a second stage scrubber diverter, a liquid discharge outlet, and a gas discharge outlet. The liquid discharge outlet is positioned adjacent to a lower portion of the second stage scrubber. The gas discharge outlet is positioned at an upper portion of the second stage scrubber.

Second stage scrubber liquids flow out the discharge outlet into a second liquid dump container adapted to receive the second stage scrubber liquids removed from the cooled first stage compressed gas. Second stage scrubber gas exits the second stage scrubber through the second stage scrubber gas discharge outlet.

The second stage scrubber gas discharge outlet is fluidly connected to the second stage compression unit. The second stage scrubber gas enters the second stage compression unit through a second stage inlet. Within the second stage compression unit, the second stage scrubber gas is compressed to form second stage compressed gas. The second stage compressed gas exits the second stage compression unit through the second stage compression unit outlet. The second stage compression unit outlet is fluidly connected to the second heat exchange unit. The second stage compressed gas enters the second heat exchange unit through a second heat exchange unit inlet. The second stage compressed gas is cooled within the second heat exchange unit such that cooled second stage compressed gas is formed. The cooled second stage compressed gas exits a second heat exchange unit outlet.

In the preferred embodiment, the compressor units are driven by a conventional and commercially available natural gas fueled reciprocating engine. The engine comprises compressor pistons positioned within cylinder cases (compressor units) in which the natural gas is compressed. The engine of the preferred embodiment is fueled by fuel gas discharged from the fuel gas outlet of the second stage scrubber.

Although the engine of the preferred embodiment is a natural gas fueled reciprocating engine, the engine need not be a natural gas fueled reciprocating engine. Rather, the engine can be natural gas-fired turbine engine, electric motor, or other suitable mechanical device adapted to compress the natural gas. The compressor units can be centrifugal compressors driven by the engines and motors mentioned herein, or other suitable compressor units adapted to compress natural gas.

The system further comprises a control unit. The control unit is operatively and communicatively coupled to various components of the system. The control unit is adapted to monitor and control various aspects of the compressors the engine, inlets and outlets, dump valves, gas flow, and the like. The control unit may comprise pressure and temperature gages, fluid level maintainers, switches, and annunciators/warning signals. The control unit may be adapted to start and stop the system, monitor pressure, temperature, liquid level, over-speed, and operation time. The control unit may comprise shock and vibration switches adapted to detect abnormal shock or excessive vibration due to system components failure. The control unit may be operatively and communicatively connected to fuel shutoff valves so that the engine and system can be shut down in the event sensor readings exceed pre-determined criteria.

In the preferred embodiment, the system comprises a skid. The overall dimensions of the system when mounted on a skid comprise a six foot width and an eleven foot length. The total weight of the system of the preferred embodiment, including the skid, is approximately 8,000 pounds. The compressors of the preferred embodiment are structured and arranged such that they are oriented vertically rather than horizontally. Conventional systems generally comprise horizontal compressors. Conventional systems generally comprise a much larger "footprint" and weigh much more.

The system of the current disclosure is adapted to operate within unique pressure parameters. In the preferred embodiment, the system is adapted to operate within a range of approximately 1 pound per square inch (psi) to 600 psi. Conventional oil and gas systems are adapted to operate at much higher pressures and therefore comprise much larger compressors. Conventional systems operate at maximum pressures of approximately 1200 psi.

As the system of the preferred embodiment is adapted to operate at a maximum pressure of 600 psi, the system may be finely adjusted such that the system may be "dialed in" to operate over a wider range of operating parameters, at lower pressure, than conventional systems, while at the same time moving the same daily volume of raw gas as larger conventional systems. At 50 HP the system of the preferred embodiment will move more mcfg/HP than conventional units. Due to the maximum pressure of approximately 600 psi, it takes less horsepower to compress gas at this pressure than at the high pressures. The compressors of the preferred embodiment move the same volume as the high pressure units but at much lower horsepower requirements. The system of the preferred embodiment, therefore, can move more mcf/hp than the larger systems.

In other embodiments, the system operates within a range of approximately 1600-2100 revolutions per minute compressing the first and second stage compressed gas within a range of 360 to 600 pounds per square inch.

In other embodiments, the system operates within a range of approximately 1600-2100 revolutions per minute compressing the first and second stage compressed gas within a range of 480 to 600 pounds per square inch.

In other embodiments, the system operates within a range of approximately 1600-2100 revolutions per minute compressing the first and second stage compressed gas within a range of 360 to 480 pounds per square inch.

In other embodiments, the system operates at 1800 revolutions per minute compressing the first and second stage compressed gas at 600 pounds per square inch.

With the compact and efficient design of the system of the present disclosure, the ratio of mcf compressed versus the mcf burned as fuel is lower than conventional systems. Since the compressors of the present disclosure comprise lower horsepower requirements, less fuel is burned. In a mcf/hp comparison, the presently disclosed system burns less fuel than a conventional system.

Horizontal compressors take up much more horizontal space than a vertical compressor. Larger compressors, including those that operate at pressures of 1200 psi or more, weigh much more than the compressors of the present disclosure. The compact design and reduced weight of the system of the present disclosure allows for ease of delivery and efficient operation.

BRIEF DESCRIPTION OF THE DRAWINGS

FIG. 1 is a plan view of the improved compression system, in accordance with a preferred embodiment.

DESCRIPTION OF THE PREFERRED EMBODIMENT

Referring to FIG. 1, there is shown the improved compression system 12 in accordance with preferred embodiments. As used herein, the terms "a" or "an" shall mean one or more than one. The term "plurality" shall mean two or more than two. The term "another" is defined as a second or more. The terms "including" and/or "having" are open ended (e.g., comprising). The term "or" as used herein is to be interpreted as inclusive or meaning any one or any combination. Therefore, "A, B or C" means "any of the following: A; B; C; A and B; A and C; B and C; A, B and C". An exception to this definition will occur only when a combination of elements, functions, steps or acts are in some way inherently mutually exclusive.

Reference throughout this document to "one embodiment," "certain embodiments," "an embodiment," or similar term means that a particular feature, structure, or characteristic described in connection with the embodiment is included in at least one embodiment of the present disclosure. Thus, the appearances of such phrases in various places throughout this specification are not necessarily all referring to the same embodiment. Furthermore, the particular features, structures, or characteristics may be combined in any suitable manner on one or more embodiments without limitation. The detailed description illustrates by way of example, not by way of limitation, the principles of the invention. This description will clearly enable one skilled in the art to make and use the invention, and describes several embodiments, adaptations, variations, alternatives, and uses of the invention, including what is presently believed to be the best mode of carrying out the invention.

Referring to FIG. 1, the improved compression system 12 generally comprises first and second stage scrubbers 14, 16, first and second heat exchange units 18, 20 comprising cooler coils 22, first and second stage compression units 24, 26 one or more liquid dump containers 28, 30, an engine 32, a control unit 34, and a bypass line 36.

A gas inlet 38 is adapted to receive a production stream of natural gas 40. The gas inlet 38 is fluidly connected to a first stage scrubber inlet 42 of the first stage scrubber 14. The first stage scrubber 14 comprises a first vessel 44, a first liquid discharge outlet 46, and a first gas discharge outlet 48. In the preferred embodiment, the first stage scrubber 14 comprises approximately a 12" diameter and a 48" height. The first liquid discharge outlet 46 is positioned adjacent to a first stage scrubber lower portion. The first gas discharge outlet 48 is positioned at a first stage scrubber upper portion. First stage scrubber liquids 54 flow out the first discharge outlet 48 into a first liquid dump container 28 adapted to receive the first stage scrubber liquids 54 removed from the production stream of natural gas 40. First stage scrubber gas 56 exits the first stage scrubber 14 through the first stage scrubber gas discharge outlet 48.

The bypass line 36 permits natural gas 40 or first stage scrubber gas 56 to pass directly from the first stage scrubber 14 to a system discharge outlet 96. In the preferred embodiment, the bypass line 36 is approximately 1 inch in diameter.

The first stage scrubber gas discharge outlet 48 is fluidly connected to the first stage compression unit 24. The first stage scrubber gas 56 enters the first stage compression unit 24 through a first stage compression unit inlet 58. Within the first stage compression unit 24, the first stage scrubber gas 56 is compressed to form first stage compressed gas 60. The first stage compressed gas 60 exits the first stage compression unit 24 through a first stage compression unit outlet 62. The first stage compression unit outlet 62 is fluidly connected to the first heat exchange unit 18.

The first stage compressed gas 60 enters the first heat exchange unit 18 through a first heat exchange unit inlet 64. The first stage compressed gas 60 is cooled within the first heat exchange unit 18 such that cooled first stage compressed gas 66 is formed. The cooled first stage compressed gas 66 exits a first heat exchange unit outlet 68. The first heat exchange unit outlet 68 is fluidly connected to the second stage scrubber unit 16.

The cooled first stage compressed gas 66 then enters the second stage scrubber 16. The second stage scrubber 16 comprises a second vessel 70, a second liquid discharge outlet 72, and a second stage gas discharge outlet 74. In the preferred embodiment, the second stage scrubber 16 comprises approximately an 8" diameter and a 48" height. The liquid discharge outlet 72 is positioned adjacent to a lower portion of the second stage scrubber 16. The gas discharge outlet 74 is positioned at an upper portion of the second stage scrubber 16. Fuel gas 78 is discharged from a fuel gas outlet 76 of the second stage scrubber 16.

Second stage scrubber liquids 80 flow out the second liquid discharge outlet 72 into a second liquid dump container 30 adapted to receive the second stage scrubber liquids 80 removed from the cooled first stage compressed gas 66. Second stage scrubber gas 82 exits the second stage scrubber 16 through the second stage gas discharge outlet 74.

The second stage gas discharge outlet 74 is fluidly connected to the second stage compression unit 26. The second stage scrubber gas 82 enters the second stage compression unit 26 through a second stage inlet 84. Within the second stage compression unit 26, the second stage scrubber gas 82 is compressed to form second stage compressed gas 86. The second stage compressed gas 86 exits the second stage compression unit 26 through the second stage compression unit outlet 88.

The second stage compression unit outlet 88 is fluidly connected to the second heat exchange unit 20. The second stage compressed gas 86 enters the second heat exchange unit through a second heat exchange unit inlet 90. The second stage compressed gas 86 is cooled within the second heat exchange unit 20 such that cooled second stage compressed gas 92 is formed. The cooled second stage compressed gas 92 exits a second heat exchange unit outlet 94. The second heat exchange unit outlet 94 is fluidly connected to the system discharge outlet 96. After exiting the second heat exchange unit outlet 94, the cooled second stage compressed gas 92 exits the system discharge outlet 96.

In the preferred embodiment, the compressor units 24, 26 are driven by a conventional and commercially available natural gas fueled reciprocating engine 32. The engine 32 comprises compressor pistons positioned within cylinder cases (compressor units 24, 26) in which the natural gas is compressed. The engine 32 of the preferred embodiment is fueled by fuel gas 78 discharged from the fuel gas outlet 76 of the second stage scrubber 16.

Although the engine 32 of the preferred embodiment is a natural gas fueled reciprocating engine 32, the engine 32 need not be a natural gas fueled reciprocating engine 32. Rather, the engine 32 can be natural gas-fired turbine engine, electric motor, or other suitable mechanical device adapted to compress the natural gas. The compressor units 24, 26 can be centrifugal compressors driven by the engines 32 and motors 32 mentioned herein, or other suitable compressor units adapted to compress natural gas.

The system 12 further comprises a control unit 34. The control unit 34 is operatively and communicatively coupled to various components of the system 12. The control unit 34 is adapted to monitor and control various aspects of the compressors 24, 26, the engine 32, inlets and outlets, dump valves, gas flow, and the like. The control unit 34 may comprise pressure and temperature gages, fluid level maintainers, switches, and annunciators/warning signals. The control unit 34 may be adapted to start and stop the system 12, monitor pressure, temperature, liquid level, over-speed, and operation time. The control unit 34 may comprise shock and vibration switches adapted to detect abnormal shock or excessive vibration due to system 12 component failure. The control unit 34 may be operatively and communicatively connected to fuel shutoff valves so that the engine 32 and system 12 can be shut down in the event sensor readings exceed pre-determined criteria.

In preferred embodiments, the control unit 34 is adapted to load or unload the system 12, as needed. In such embodiments, the control unit 34 monitors pressures at the first stage scrubber inlet 42. If excess pressure is present at this inlet 42, the control unit 34 is adapted to activate a pressure relief mechanism 35. The control unit 34, using the pressure relief mechanism, reduces the pressure at the first stage scrubber inlet 42 to a predetermined psi. Upon reaching this pre-determined psi, the control unit directs the starting of the system 12 such that gas flows through the first stage scrubber 14, the first stage compression unit 24 and the other system components, as described herein.

The control unit 34 is further adapted to change the engine's 32 rpm based upon the pressure of the production stream of natural gas 40 proximate to the first stage scrubber inlet 42. For example, if the control unit 34 detects that the pressure of the production stream of natural gas 40 proximate to the first stage scrubber inlet 42 exceeds a predetermined level, the control unit is adapted to direct that the engine's 32 rpm be reduced. Conversely, if the control unit 34 detects that the pressure of the production stream of natural gas 40 proximate to the first stage scrubber inlet 42 is less than a pre-determined level, the control unit is adapted to direct that the engine's 32 rpm be increased.

In some embodiments, the system 12 comprises an automated valve 13. The automated valve 13 is structured and arranged to regulate flow of the first stage scrubber gas 56 to the bypass line 36. The control unit 34 is adapted to control the automated valve 13 such that flow of first stage scrubber gas 56 may be maintained at a pre-determined level, reduced, increased, started, or stopped. In a preferred embodiment, the automated valve 13 is a one inch valve 13 communicatively connected to the control unit 34.

In the preferred embodiment, the system 12 comprises a skid 50. Each of the other components of the system 12 is mounted to this skid 50. The overall dimensions of the system 12 when mounted on a skid 50 comprise a six foot width and an eleven foot length. The total weight of the system 12 of the preferred embodiment, including the skid 50, is approximately 8,000 pounds. In other embodiments, the system 12 weighs approximately 7400 pounds. The compressor units 24, 26 of the preferred embodiment are structured and arranged such that they are oriented vertically rather than horizontally.

The system 12 of the current disclosure is adapted to operate within unique pressure parameters. In the preferred embodiment, the system 12 is adapted to operate within a range of approximately 1 pound per square inch (psi) to 600 psi. As the system 12 of the preferred embodiment is adapted to operate at a maximum pressure of approximately 600 psi, the system 12 may be finely adjusted such that the system 12 may be "dialed in" to operate over a wider range of operating parameters, at lower pressure, than conventional systems, while at the same time moving the same daily volume of raw gas as larger conventional systems.

The system 12 may be configured to operate at a desired efficiency level. In a preferred embodiment, the system 12 is configured to operate at 50 or less HP and at 600 psi or less (such that first and second stage scrubber gas 60, 86 are compressed to 600 psi or less). At 50 HP the system 12 of the preferred embodiment will move more mcfg/HP than conventional systems. Due to the max pressure of approximately 600 psi, it takes less horsepower to compress gas at this pressure than at higher pressures.

In other embodiments, the system 12 operates within a range of approximately 1600-2100 revolutions per minute compressing the first and second stage compressed gas 60, 86 within a range of 360 to 600 pounds per square inch.

In other embodiments, the system 12 operates within a range of approximately 1600-2100 revolutions per minute compressing the first and second stage compressed gas 60, 86 within a range of 480 to 600 pounds per square inch.

In other embodiments, the system operates within a range of approximately 1600-2100 revolutions per minute compressing the first and second stage compressed gas 60, 86 within a range of 360 to 480 pounds per square inch.

In other embodiments, the system operates at 1800 revolutions per minute compressing the first and second stage compressed gas 60, 86 at 600 pounds per square inch.

The compressors 24, 26 of the preferred embodiment are structured and arranged to move the same volume as the high pressure units but at much lower horsepower requirements. The system 12 of the preferred embodiment, therefore, can move more mcf/hp than conventional systems. In preferred embodiments, the system 12 can efficiently move 450 thousand cubic feet of gas per day (MCFGD).

In preferred embodiments, the system 12 comprises a low weight to MCFGD ratio (wt/mcfgd). In preferred embodiments, the system 12 comprises wt/mcfgd ratios of less than 20. For example, in a preferred embodiment, the system weighs 7400 pounds and generates 450 MCFGD. This is a 16.44 wt/mcfgd ratio (7400/450). In other embodiments, the system 12 comprises a 17.777 wt/mcfgd ratio (8000/450).

With the compact and efficient design of the system 12 of the present disclosure, the ratio of mcf compressed versus the mcf burned as fuel is lower than conventional systems. Since the compressors of the present disclosure comprise lower horsepower requirements, less fuel is burned. In an mcf/hp comparison, the presently disclosed system 12 burns less fuel than a conventional system.

The compact design and reduced weight of the system 12 of the present disclosure allows for ease of delivery and efficient operation.

While there has been illustrated and described what is, at present, considered to be a preferred embodiment of the present invention, it will be understood by those skilled in the art that various changes and modifications may be made, and equivalents may be substituted for elements thereof without departing from the true scope of the invention. Therefore, it is intended that this invention not be limited to the particular embodiment disclosed as the best mode contemplated for carrying out the invention, but that the invention will include all embodiments falling within the scope of this disclosure.

I claim:

1. A compression system comprising:

a main fluid inlet adapted to receive a production stream of natural gas; first and second stage scrubbers; first and second compression units; first and second heat exchange units; one or more liquid dump containers; an engine;

the first and second stage scrubbers each comprising a vessel, a scrubber fluid inlet, a liquid discharge outlet, and a gas discharge outlet;

the main fluid inlet being fluidly connected to the first scrubber;

the first stage scrubber being structured and arranged to discharge, through said first stage scrubber liquid discharge outlet, first stage scrubber liquids;

the first stage scrubber being further structured and arranged to discharge, through said first stage scrubber gas discharge outlet, first stage scrubber gas;

the first compression unit being structured and arranged to receive and compress the first stage scrubber gas to form first stage compressed gas;

the first heat exchange unit structured and arranged to receive and cool the first stage compressed gas to form cooled first stage compressed gas;

the second stage scrubber being structured and arranged to receive the cooled first stage compressed gas and to discharge, through said second stage scrubber liquid discharge outlet, second stage scrubber liquids;

the second stage scrubber being further structured and arranged to discharge, through said second stage scrubber gas discharge outlet, second stage scrubber gas;

the second compression unit being structured and arranged to receive and compress the second stage scrubber gas to form second stage compressed gas;

the second heat exchange unit adapted to receive and cool the second stage compressed gas to form cooled second stage compressed gas;

the one or more liquid dump containers being adapted to receive one or both of the first and second stage scrubber liquids; and wherein the compression system comprises a weight to thousand cubic feet of gas per day ratio, said ratio being less than twenty.

2. The compression system of claim 1 further comprising a bypass line, the bypass line being adapted to receive first stage scrubber fluids and discharge such first stage scrubber fluids through a main discharge outlet.

3. The compression system of claim 1 further comprising a control unit adapted to monitor and control the engine and compression units;

the engine operating within a range of 1600-2100 revolutions per minute; and wherein, the second stage compressed gas comprises a pressure within a range of 360-600 pounds per square inch.

4. The compression system of claim 3 further comprising:

an automated valve;

a bypass line, the bypass line being adapted to receive first stage scrubber fluids and discharge such first stage scrubber fluids through a main discharge outlet;

the automated valve comprising open and closed positions that regulate flow of the first stage scrubber fluids to the bypass line; and the automated valve and control unit being communicatively coupled such that the control unit is adapted to direct movement of the automated valve from the open position and from the closed position.

5. The compression system of claim 3, the engine operating at 1800 revolutions per minute and the second stage compressed gas comprising a pressure of 600 pounds per square inch.

6. The compression system of claim 3, the engine operating within a range of 1600-2100 revolutions per minute and the second stage compressed gas comprising a pressure within a range of 480 to 600 pounds per square inch.

7. The compression system of claim 3, the engine operating within a range of 1600-2100 revolutions per minute and the second stage compressed gas comprising a pressure within a range of 360 to 480 pounds per square inch.

8. The compression system of claim 1 wherein the compression units are vertically arranged such that heights of the respective compression units exceed widths of the respective compression units.

9. The compression system of claim 1 wherein the second stage scrubber discharges fuel gas.

10. The compression system of claim 7 wherein the fuel gas powers the engine.

11. The compression system of claim 1 wherein the cooled second stage compressed gas is discharged from the system through a main discharge outlet.

12. The compression system of claim 1 further comprising a skid, the main fluid inlet, the first and second stage scrubbers, the first and second compression units, the first and second heat exchange units, the one or more liquid dump containers, and the engine being mounted on said skid.

13. The compression system of claim 11, the skid comprising a six foot width and an eleven foot length.

* * * * *